US006769791B2

(12) United States Patent
Kovacik et al.

(10) Patent No.: US 6,769,791 B2
(45) Date of Patent: Aug. 3, 2004

(54) QUADRUPLE LAMP UTILITY LIGHT

(75) Inventors: James D. Kovacik, Brecksville, OH (US); Paul S. Blanch, Broadview Heights, OH (US); Joseph J. Smith, Wooster, OH (US)

(73) Assignee: Alert Safety Lite Products Co, Inc., Bedford Heights, IL (US)

( * ) Notice: Subject to any disclaimer, the term of this patent is extended or adjusted under 35 U.S.C. 154(b) by 283 days.

(21) Appl. No.: 10/008,975

(22) Filed: Nov. 7, 2001

(65) Prior Publication Data

US 2003/0086268 A1 May 8, 2003

(51) Int. Cl.[7] ..... F21V 7/12; F21S 3/12
(52) U.S. Cl. ..... 362/287; 362/427; 362/250
(58) Field of Search ..... 362/249, 250, 362/251, 287, 427, 396, 410

(56) References Cited

U.S. PATENT DOCUMENTS

| | | | | | |
|---|---|---|---|---|---|
| 3,560,730 | A | | 2/1971 | Morton | |
| 4,463,413 | A | * | 7/1984 | Shirley | 362/401 |
| 4,598,344 | A | | 7/1986 | Nadler | |
| 5,050,055 | A | | 9/1991 | Lindsay et al. | |
| 5,195,823 | A | * | 3/1993 | Sidabras | 362/387 |
| 5,243,507 | A | * | 9/1993 | Atkins et al. | 362/376 |
| 5,386,358 | A | * | 1/1995 | Hillinger | 362/431 |
| 5,541,822 | A | | 7/1996 | Bamber | |
| 5,921,658 | A | | 7/1999 | Kovacik et al. | |
| 5,984,490 | A | * | 11/1999 | Leen | 362/240 |
| D421,143 | S | | 2/2000 | Kovacik et al. | |
| 6,176,592 | B1 | | 1/2001 | Kovacik et al. | |
| 6,554,459 | B2 | * | 4/2003 | Yu et al. | 362/418 |

* cited by examiner

*Primary Examiner*—Thomas M. Sember
(74) *Attorney, Agent, or Firm*—MacMillan, Sobanski & Todd, LLC

(57) ABSTRACT

A utility light includes a housing having a lens opening closed by a removable lens. Four fluorescent twin lamp assemblies mounted in the housing are separately switched in pairs to provide two levels of illumination. The housing is pivotally mounted on a stand for rotation about a first axis. The housing can be supported freestanding by the stand or attached to a support surface utilizing the stand. A hook mounted on the stand permits the housing and the stand to be rotated about a second axis.

19 Claims, 5 Drawing Sheets

36
10
43
42
45
41
50
11
43
45
13
14
32
45
45
34
33
35
34
38
12
35
37
39
40
28
23
17
29
27
26
30
Y
31

10
12
34
23
40
21
20
19
42
13
15
16
18
24
17
25
37
30
27
29
26
28
45
35
43
46
36
50
32
33
48
47
14

QUADRUPLE LAMP UTILITY LIGHT

BACKGROUND OF THE INVENTION

The present invention relates generally to illumination devices and, in particular, to a utility light with four twin fluorescent lamp assemblies.

Portable lights, that can be manually moved and suspended about a work site to aid a user to obtain the best lighting conditions, are well known. Such lights are often referred to as trouble lamps, extension lights, work lights, inspection lights, utility lights, and the like, and are commonly employed by mechanics and other workers who require a concentration of light while frequently changing locations. Such lights have developed from using incandescent bulbs to using fluorescent bulbs. The fluorescent bulbs have several advantages in use as compared with the incandescent bulbs. For example, a fluorescent light bulb usually provides more light with less glare than an incandescent light bulb of the same wattage.

Many prior art utility lights are designed to be handheld, which is advantageous in that they may be easily moved to many locations. While their portability and light weight is advantageous, handheld lights are often limited in the amount of illumination that they can provide because the larger bulbs, support assemblies and power supply components required to provide more illumination increase the weight and would make the handheld light more difficult to hold and orient.

There are occasions when a utility light that produces a greater amount of illumination than a typical handheld light is preferred. Prior art utility lights of this type, however, typically utilize halogen bulbs and are large in size, produce a great amount of heat, and are less portable than a typical handheld light. The amount of heat produced by these halogen lights disadvantageously limits their use to outdoor use only, which those skilled in the art will appreciate is a significant limitation. Those skilled in the art will also appreciate that though a greater amount of illumination is preferred at times, the same amount of illumination is not in required for every work location.

It is desirable to provide a utility light that can be used indoors and that produces a greater amount of illumination than conventional utility lights without generating an undesirable amount of heat. It is desirable to provide such a utility light while still providing a degree of portability. It is also desirable to provide a utility light that is able to vary the amount of illumination it provides and that may be produced in a cost-effective manner.

It is, therefore, an object of the invention to provide a portable utility light that produces a greater amount of illumination than standard utility lights without generating an undesirable amount of heat, and that can vary the amount of illumination that it provides.

SUMMARY OF THE INVENTION

The present invention concerns a quadruple lamp utility light having a housing pivotally mounted on a stand for rotation about a horizontal axis. Once positioned, the housing can be locked against further rotation relative to the stand. The stand functions as a base to support the utility light in a freestanding position and functions as a mounting bracket for attaching to a surface. The utility light stand also has a hook for hanging the utility light permitting rotation about a vertical axis. The hook is movable to a stored position on the stand when not in use.

The housing encloses four fluorescent twin lamp assemblies that can be switched on and off in pairs to vary the amount of illumination generated. Cooling of the interior of the housing is provided by upper and lower sets of slots formed in the rear of the housing and in a lens at the front of the housing.

The utility light according to the present invention includes: a housing having a hollow interior and a lens opening closed by a transparent lens; a stand pivotally attached to the housing, the housing being rotatable about a first axis of rotation relative to the stand for orienting the lens; a locking means on the housing for selectively engaging the stand to prevent rotation of the housing relative to the stand; and a hook mounted on the stand for movement between a stored position and an in-use position, the housing being rotatable about a second axis of rotation relative to the hook when the hook is in the in-use position for supporting the housing and orienting the lens. The stand includes a bar having an upstanding leg at each end thereof and the hook is positioned between the bar and the housing in the stored position. The utility light includes a pair of feet attached to the bar adjacent associated ones of the legs, the bar and the feet cooperating to support the housing freestanding on a generally horizontal surface. At least one aperture is formed in the stand for attaching the stand and the housing to a support surface with a fastener.

The locking means includes a pair of threaded studs extending from opposite sides of the housing defining the first axis of rotation, the studs extending through the stand, and a pair of knobs threadably engaging free ends of the studs, whereby when the knobs are tightened on the studs, the stand is forced against the housing to prevent rotation of the housing about the first axis of rotation. A first plurality of cooling slots are formed in the lens adjacent a bottom edge of the lens and a second plurality of cooling slots are formed in the lens adjacent a top edge of the lens. Similarly, a first plurality of cooling slots are formed in a bottom portion of the housing and a second plurality of cooling slots are formed in the housing adjacent a top edge of the housing.

The utility light includes at least one lamp assembly mounted in the housing adjacent the lens and at least one support post extending from a rear interior surface of the housing and having a free end engaging the at least one lamp assembly. A lamp cushion is mounted on the free end of the at least one support post in contact with the at least one lamp assembly. At least another support post extending from an interior surface of the lens and has a free end engaging the at least one lamp assembly and another lamp cushion mounted on the free end of the another support post in contact with the at least one lamp assembly.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
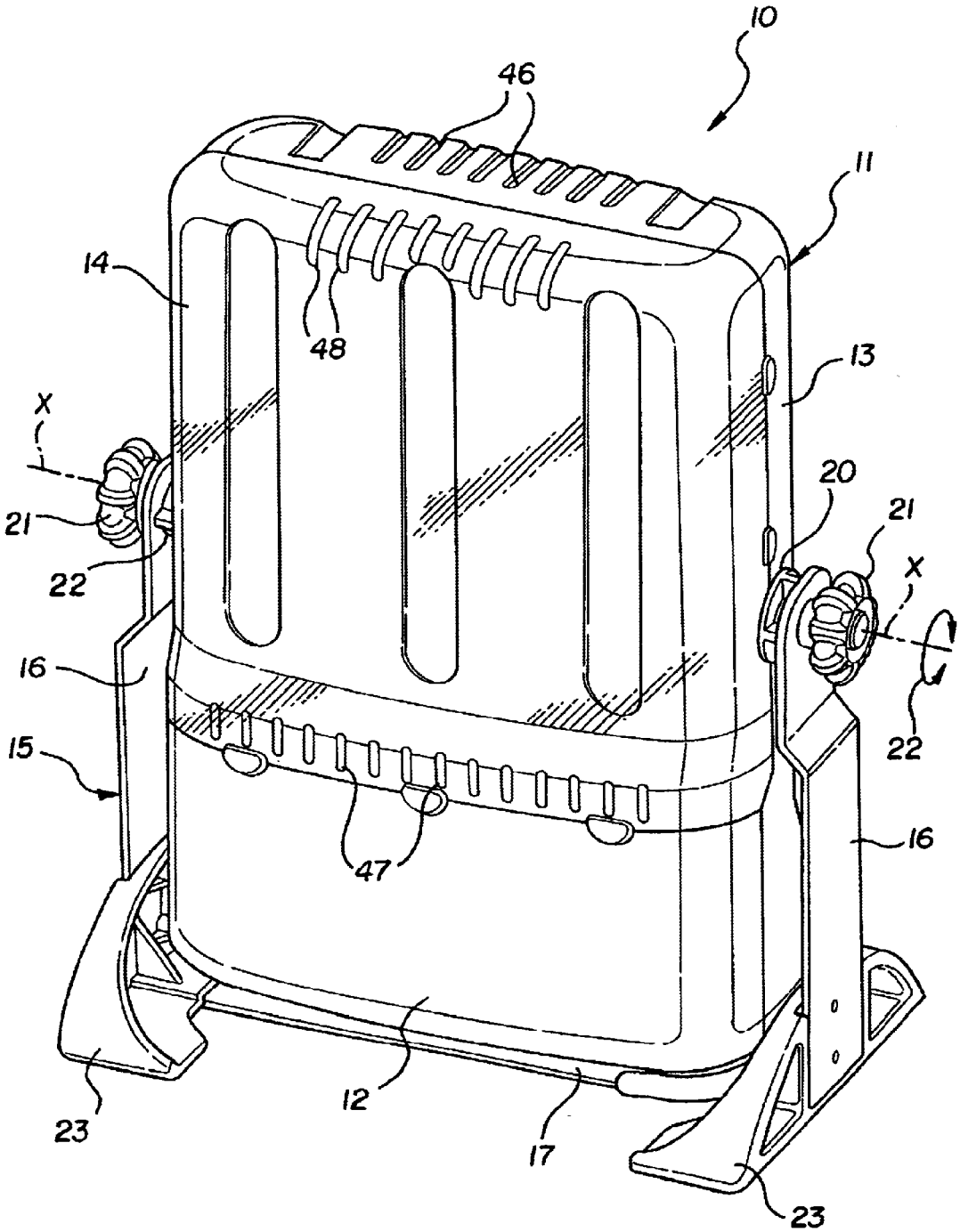
FIG. 1 is a front perspective view of a utility light in accordance with the present invention.

Referring to all of the drawings, a utility light according to the present invention is shown generally at 10. The light 10 includes a hollow housing 11 having a front shell 12 attached to a rear shell 13. The front shell 12 has a lens opening closed by a removable transparent lens 14. A generally U-shaped stand 15 includes a pair of upstanding legs 16 attached at lower ends to opposite ends of a generally planar bar 17. Upper ends of the legs 16 each includes an aperture 18 through which extends a threaded stud 19. The studs 19 each project from an associated boss 20 on opposite sides of the rear shell 13. Each of a pair of knobs 21 threadably engages a free end of an associated one of the studs 19 to retain the associated leg 16 on the stud. When the knobs 21 are tightened, the legs 16 are held against the bosses 20 so that the housing 11 cannot move relative to the stand 15. When the knobs 21 are loosened, the housing 11 can be rotated relative to the stand 15 about a first axis X extending along aligned longitudinal axes of the studs 19. The studs 19 are positioned approximated midway between the top and bottom of the housing 11. Thus, the direction of the illumination emitted from the lens 14 can be selectively rotated 360° about the first axis X as shown by the arrows 22 in FIG. 1 and the housing 11 locked in a desired position utilizing the knobs 19.

A pair of feet 23 are attached at the juncture of the legs 16 with the bar 17. The feet 23 extend transversely from opposite edges of the bar 17 and have lower surfaces provided with ribs for supporting the light 10. Formed in the bar 17 are slotted apertures 24 each for receiving a head of a fastener (not shown). A hook 25 is stored on a top surface of the bar 17 and has a ball 26 at a free end of a shank 27. The ball 26 is rotatably retained between an upper socket member 28 and a lower socket member 29 attached to the bar adjacent a recess 30 is formed in an edge of the bar. The hook 25 can be moved from the stored position shown in FIG. 1 to an extended "in-use" position shown in FIG. 2. When in the position shown in FIG. 2, the hook 25 can be rotated 360° about a second axis Y perpendicular to the first axis X as indicated by arrows 31.

The shells 12 and 13, the knobs 21 and the feet 23 can be formed from a suitable plastic material such as an ABS material. The lens 14 can be formed from another suitable plastic material such as a polycarbonate material.

Figure 2:
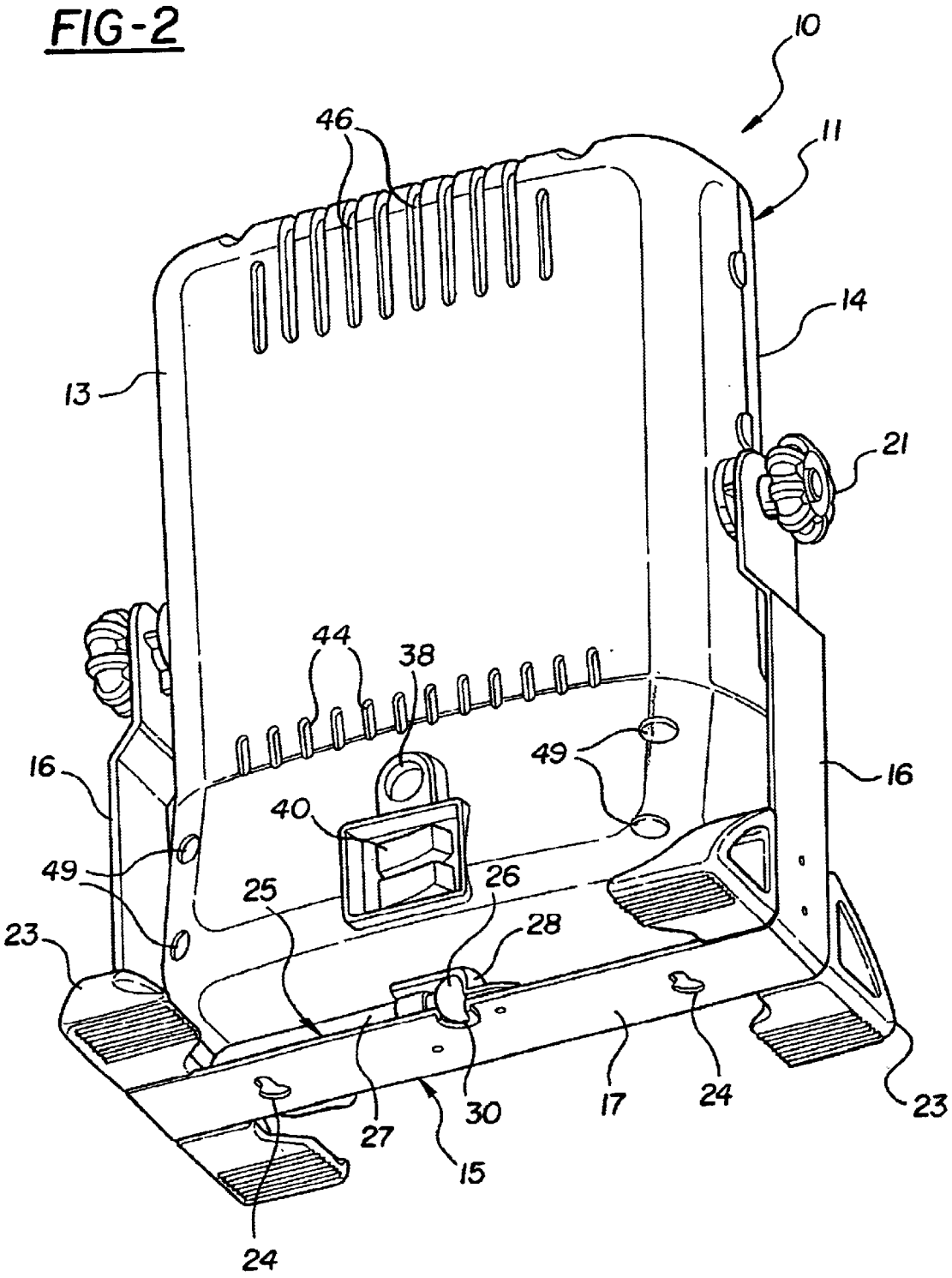
FIG. 2 is a rear perspective view of the utility light shown in FIG. 1.
Figure 3:
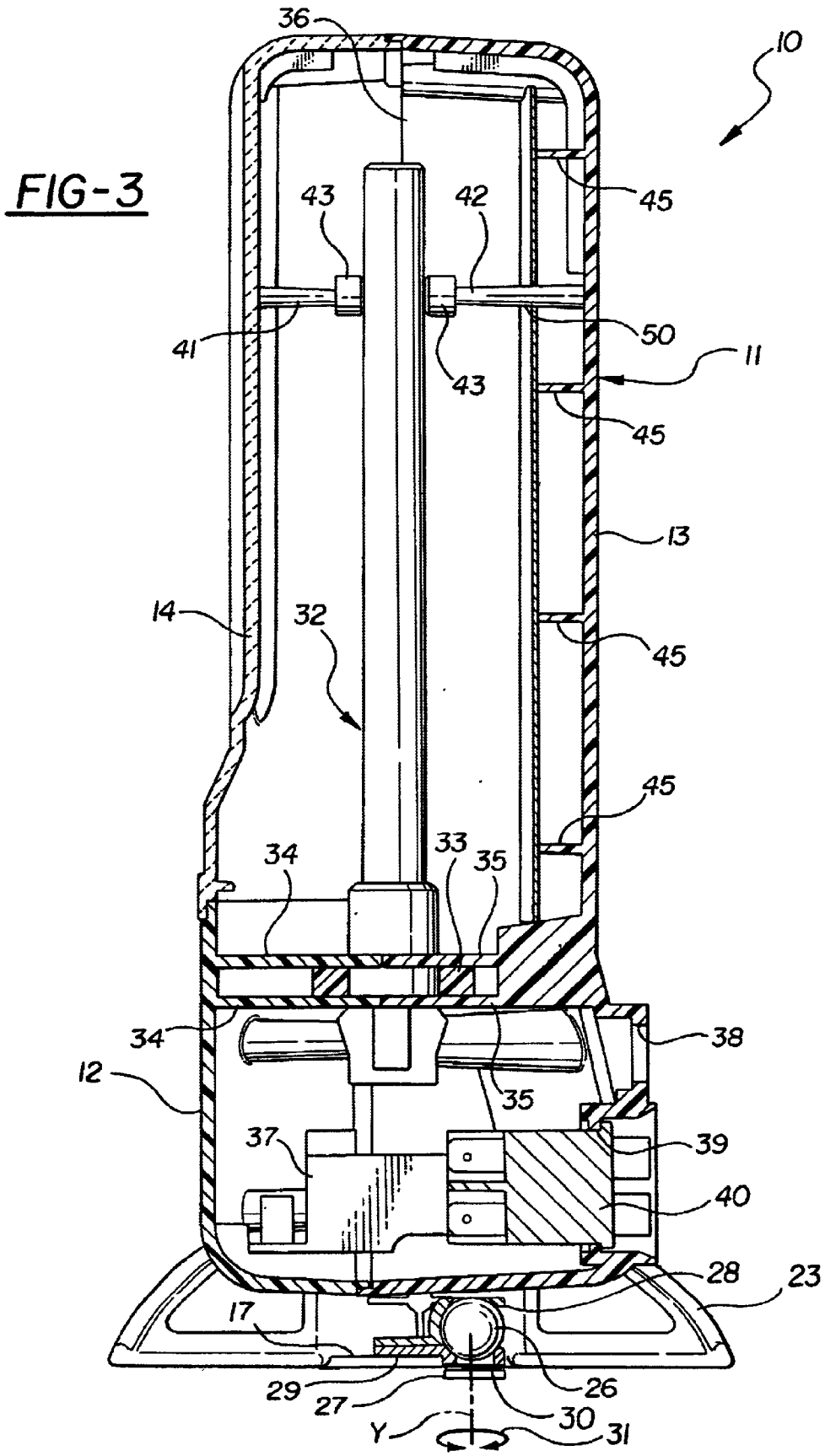
FIG. 3 is a vertical cross-sectional view of the utility light shown in FIG. 1 viewed from the right side.
Figure 4:
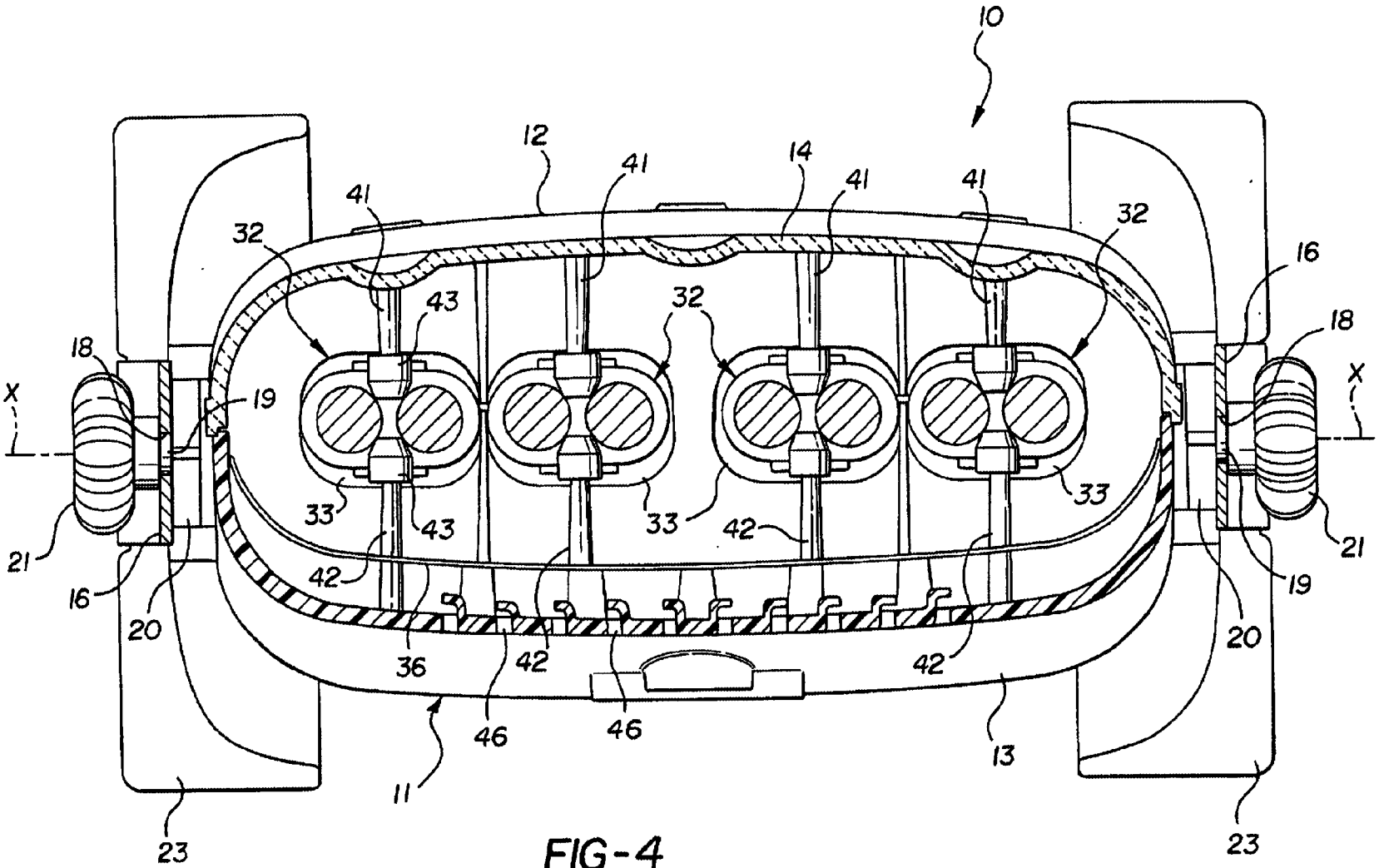
FIG. 4 is a horizontal cross-sectional view of the utility light shown in FIG. 1 viewed from the top.
Figure 5:
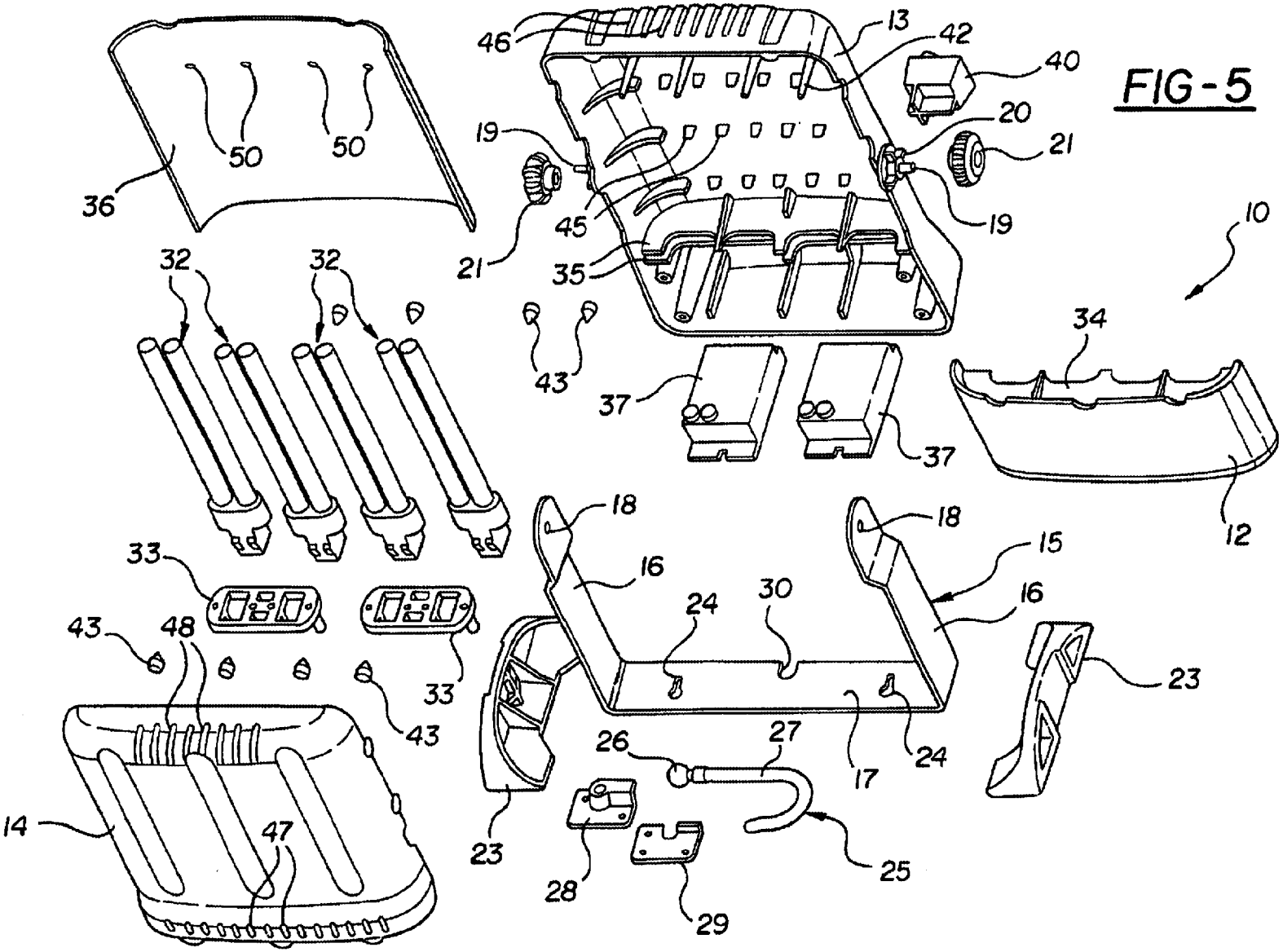
FIG. 5 is an exploded perspective view of the utility light shown in FIG. 1.

The utility light 10 can be used in at least three different ways. In a first mode of use, the light 10 can rest freestanding supported on a generally horizontal surface by the bar 17 and the feet 23. The housing 11 can be rotated about the first axis X in a vertical plane to direct the illumination emitted from the lens 14. In a second mode of use, the hook 25 can be extended as shown in FIG. 2 and the utility light 10 suspended upside down from the hook. In this position, the housing 11 can be rotated about the first axis X and also can be rotated about the second axis Y to provide spherical illumination coverage. In a third mode of operation, the slotted apertures 24 can accept the heads of screws (not shown) for mounting the utility light 10 on a generally planar surface permitting the housing 11 to be rotated about the first axis X to direct the illumination.

Mounted inside the housing 11 are four fluorescent lamp assemblies 32 each having two tubes and being removably received in an associated one of two dual sockets 33. The sockets 33 are retained in a lower portion of the housing 11 by a pair of horizontally extending spaced apart retaining flanges 34 extending from an interior surface of the front shell 12 and a cooperating pair of horizontally extending spaced apart retaining flanges 35 extending from an interior surface of the rear shell 13. The twin lamp assemblies 32 extend upwardly from the sockets 33 into an upper portion of the housing 11 adjacent the lens 14. The sockets 33 are oriented to align the lamp assemblies 32 with the tubes in a vertical plane generally parallel to the plane of a central portion of the lens 14. A reflector 36 is mounted in the rear shell 13 between the lamp assemblies 32 and an inner wall of the rear shell to reflect light generated by the lamps through the lens 14. The reflector 36 can be formed of a suitable material such as a silver reflective Mylar. The reflector 36 is a flat sheet of suitable thickness to enable it to be bent at opposite side edges as shown in FIG. 34 to conform to the contours of the rear shell 13. Thus, a portion of light generated by the lamp assemblies 32 directly exits the housing 11 through the lens 14 while another portion of the light strikes the reflector 36 is directed through the lens.

Mounted in the housing 11 below the sockets 33 are two power modules 37 for supplying electrical power to the twin lamp assemblies 32. The rear shell 13 has a cord aperture 38 formed in a lower portion of a rear wall through which a power cord (not shown) can extend. Below the cord aperture 38 there is formed a switch aperture 39 in which is mounted a dual switch assembly 40. The assembly 40 has two separate rocker-type switches each of which is wired to provide electrical power from a power cord (not shown) to an associated one of the power modules 37. In turn, each of the power modules 37 is wired to one of the sockets 33 to provide electrical power to the two lamp assemblies 32 mounted therein. Either one of the switches of the switch assembly 40 can be turned on to provide a first level of illumination from the two associated lamp assemblies 32, or both of the switches can be turned on to provide a second higher level of illumination from all of the lamp assemblies. Although four of the lamp assemblies 32 and the dual switch assembly 40 are shown, any suitable number of lamp assemblies can be used with the number of switches required to provide the desired levels of illumination.

The front shell 12 has four support posts 41 that extend from an upper portion of the inner surface toward the rear shell 13. The rear shell 13 has four support posts 42 that extend from an upper portion of the inner surface toward the front shell 12. The posts 41 and 42 are aligned in cooperating pairs with free ends of the posts in each pair extending adjacent upper ends of the twin tubes of an associated one of the lamp assemblies 32. A lamp cushion 43, preferably made from a silicone material, is mounted on the free end of each of the posts 41 and 42. The lamp cushions 43 extend between and abut the tubes of the associated lamp assemblies 32 to support and cushion against shock and vibration.

Heat generated in the housing 11 from the conversion of electrical power into light must be dissipated. A plurality of vertically extending inlet cooling slots 44 are formed through the wall of the rear shell 13 in a bottom portion thereof just above the cord aperture 38 for drawing ambient temperature cooling air into the housing 11 at the base of the reflector 36. The reflector 36 is spaced from the interior surface of the rear shell 13 by a plurality of spaced tabs 45 projecting from the interior surface. A plurality of vertically extending outlet slots 46 are formed through the wall of the rear shell 13 adjacent a top edge of the housing 11 and extend into a top wall of the shell. Since hot air rises, a convection current is established in the space between the shell 13 and the reflector 36 drawing ambient temperature air into the housing 11 through the inlet slots 44 and exhausting heated air through the outlet slots 46.

A plurality of vertically extending inlet slots 47 are formed through the wall of the lens 14 just above a bottom edge thereof for drawing ambient temperature cooling air into the housing 11 at the base of the lamp assemblies 32. A plurality of vertically extending outlet slots 48 are formed through the wall of the lens 14 at top edge of thereof and extend into a top wall of the lens. Since hot air rises, a convection current is established in the space between the lens 14 and the lamp assemblies 32 drawing ambient temperature air into the housing 11 through the inlet slots 47 and exhausting air heated in the housing through the outlet slots 48.

The front shell 12 and the rear shell 13 are held together by a plurality of threaded fasteners 49 extending through apertures (not shown) in the rear shell and threadably engaging bosses (not shown) in the interior of the front shell. In a similar manner, a pair of threaded fasteners (not shown) extend through apertures (not shown) in the rear shell and threadably engage bosses (not shown) in the interior of the lens 14. Further, the reflector 36 has a plurality of apertures 50 formed therein for accepting the support posts 42 to maintain the reflector in a vertical position against the tabs 45.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A utility light comprising:

a housing having a hollow interior and a lens opening closed by a transparent lens;

a stand pivotally attached to said housing, said housing being rotatable about a first axis of rotation relative to said stand for orienting said lens;

a locking means on said housing for selectively engaging said stand to prevent rotation of said housing relative to said stand; and a hook mounted on said stand for movement between a stored position and an in-use position, said housing being rotatable about a second axis of rotation relative to said hook when said hook is in said in-use position for supporting said housing and orienting said lens.

2. The utility light according to claim 1 wherein said stand includes a bar having an upstanding leg at each end thereof and said hook is positioned between said bar and said housing in said stored position.

3. The utility light according to claim 2 including a pair of feet attached to said bar adjacent associated ones of said legs, said bar and said feet cooperating to support said housing freestanding on a generally horizontal surface.

4. The utility light according to claim 1 including at least one aperture formed in said stand for attacking said stand and said housing to a support surface with a fastener.

5. The utility light according to claim 1 wherein said locking means includes a pair of threaded studs extending from opposite sides of said housing defining said first axis of rotation, said studs extending through said stand, and, a pair of knobs threadably engaging free ends of said studs, whereby when said knobs are tightened on said studs, said stand is forced against said housing to prevent rotation of said housing about said first axis of rotation.

6. The utility light according to claim 1 including a first plurality of cooling slots formed in said lens adjacent a bottom edge of said lens and a second plurality of cooling slots formed in said lens adjacent a top edge of said lens.

7. The utility light according to claim 1 including a first plurality of cooling slots formed in a bottom portion of said housing and a second plurality of cooling slots formed in said housing adjacent a top edge of said housing.

8. The utility light according to claim 1 including at least one lamp assembly mounted in said housing adjacent said lens and at least one support post extending from a rear interior surface of said housing and having a free end engaging said at least one lamp assembly.

9. The utility light according to claim 8 including a lamp cushion mourned on said free end of said at least one support post in contact with said at least one lamp assembly.

10. The utility light according to claim 9 including at least another support post extending from an interior surface of said lens and having a free end engaging said at least one lamp assembly and another lamp cushion mounted on said free end of said another support post in contact with said at least one lamp assembly.

11. The utility light according to claim 1 including a socket mounted on said stand, said book having a ball rotatably retained in said socket.

12. A utility light comprising:

a housing having a hollow interior and a lens opening closed by a transparent lens;

at least two lamp assemblies mounted in said housing in line for generating light through said lens;

two switches mounted on said housing, each said switch turning on and off an associated one of said at least two lamp assemblies;

a stand pivotally attached to said housing, said housing being rotatable about a first axis of rotation relative to said stand;

a hook mounted on said stand for movement between a stored position and an in-use position for suspending said housing, said housing being rotatable about a second axis of rotation relative to said hook when said hook is in said in-use position; and a locking means on said housing for selectively engaging said stand to prevent rotation of said housing relative to said stand.

13. The utility light according to claim 12 wherein said stand includes a pair of feet for supporting said housing freestanding on a generally horizontal surface.

14. The utility light according to claim 12 including at least one aperture formed in said stand for attaching said stand and said housing to a support surface with a fastener.

15. A utility light comprising:

a housing having a hollow interior and a lens opening closed by a removable transparent lens;

four fluorescent twin lamp assemblies mounted in said housing in line for generating light through said lens two switches mounted on said housing, each said switch turning on and off an associated pair of said twin lamp assemblies;

a stand pivotally attached to said housing, said housing being rotatable about a first axis of rotation relative to said stand;

a locking means on said housing for selectively engaging said stand to prevent rotation of said housing relative to said stand; and a hook mounted on said housing for movement between a stored position and an in-use position, said housing being rotatable about a second axis of rotation relative to said hook when said hook is in said in-use position.

16. The utility light according to claim 15 including a first plurality of cooling slots formed in said lens adjacent a bottom edge of said lens and a second plurality of cooling slots formed in said lens adjacent a top edge of said lens.

17. The utility light according to claim 15 including a first plurality of cooling slots formed in a bottom portion of said housing and a second plurality of cooling slots formed in said housing adjacent a top edge of said housing.

18. The utility light according to claim 15 including a plurality of support posts extending from a rear interior surface of said housing and an interior surface of said lens, each said support post having a free end, and a plurality of lamp cushions each mounted on said free end of and associated one of said support posts and in contact with an associated one of said lamp assemblies.

19. The utility light according to claim 15 wherein said locking means includes a pair of threaded studs extending from opposite sides of said housing defining said first axis of rotation, said studs extending through said stand, and a pair of knobs threadably engaging free ends of said studs, whereby when said knobs are tightened on said studs, said stand is forced against said housing to prevent rotation of said housing about said first axis of rotation.

* * * * *